US005306326A

United States Patent [19]

Oskarsson et al.

[11] Patent Number: 5,306,326

[45] Date of Patent: Apr. 26, 1994

[54] TITANIUM BASED CARBONITRIDE ALLOY WITH BINDER PHASE ENRICHMENT

[75] Inventors: Rolf G. Oskarsson, Ronninge; Gerold Weinl, Alvsjo, both of Sweden

[73] Assignee: Sandvik AB, Sandviken, Sweden

[21] Appl. No.: 886,885

[22] Filed: May 22, 1992

[30] Foreign Application Priority Data

May 24, 1991 [SE] Sweden ..... 9101590

[51] Int. Cl.[5] ..... C22C 29/02

[52] U.S. Cl. ..... 75/238; 75/239; 75/240; 75/242; 75/244; 75/236; 428/547; 428/552; 428/687

[58] Field of Search ..... 75/238, 242, 236, 244, 75/239, 240, 246; 428/547, 552, 687

[56] References Cited

U.S. PATENT DOCUMENTS

| | | | |
|---|---|---|---|
| 4,277,283 | 7/1981 | Tobioka et al. | 75/238 |
| 4,497,874 | 2/1985 | Hale | 428/551 |
| 4,548,786 | 10/1985 | Yohe | 419/29 |
| 4,610,931 | 9/1986 | Nemeth et al. | 428/547 |
| 4,649,048 | 3/1987 | Johnson | 424/81 |
| 4,828,612 | 5/1989 | Yohe | 75/238 |
| 4,830,930 | 5/1989 | Taniguchi et al. | 428/547 |
| 4,911,989 | 3/1990 | Minoru et al. | 428/547 |
| 4,957,548 | 9/1990 | Shima et al. | 75/238 |
| 4,963,321 | 10/1990 | Saitoh et al. | 419/13 |
| 4,990,410 | 2/1991 | Saitoh et al. | 428/547 |
| 5,051,126 | 9/1991 | Yasui et al. | 75/238 |
| 5,059,491 | 10/1991 | Odani et al. | 428/614 |

*Primary Examiner*—Donald P. Walsh
*Assistant Examiner*—Ngoclan T. Mai
*Attorney, Agent, or Firm*—Burns, Doane, Swecker & Mathis

[57] ABSTRACT

A sintered body of titanium based carbonitride alloy containing hard constituents based on, in addition to titanium, one or more of the metals Zr, Hf, V, Nb, Ta, Cr, No or W in 5-30% binder phase based on Co and/or Ni is disclosed. The body has a binder phase enriched surface zone with a higher binder phase content than in the inner portion of the body in combination with an enrichment of simple hard constituents, i.e., the share of grains with core-rim structure is lower in the surface zone than in the inner of the body.

8 Claims, 2 Drawing Sheets

A

TITANIUM BASED CARBONITRIDE ALLOY WITH BINDER PHASE ENRICHMENT

BACKGROUND OF THE INVENTION

The present invention relates to a sintered body of a carbonitride alloy with titanium as main component which has improved properties particularly when used as cutting tool inserts in intermittent metal cutting operations under particularly toughness demanding conditions. This has been done by a different distribution of hard constituents and binder phase between the surface layer and inner (bulk) zone and a different form of the hard constituents in the surface zone and bulk zone in regard to simple and complex structures, particularly different core-rim-situations.

Titanium based carbonitrides (so-called cerments) are today well established in the metal cutting industry and are primarily used as tools for finishing. They consist of hard constituents of titanium-based carbonitride embedded in a binder phase of cobalt and/or nickel. The hard constituents generally have a complex structure with a core surrounded by a rim of a different composition.

For tungsten carbide-cobalt-based hard metals, the so-called gradient sintered grades, particularly when coated with one or more CVD layers, have now gained strong foothold in metal-cutting inserts. Gradient sintering means that the sintering is performed in such a way that an about 10 μm wide surface zone of the material gets another composition that its inner part, particularly with a higher binder phase content in the surface zone. Examples of patents within this area are U.S. Pat. Nos. 4,277,283, 4,610,931, 4,497,874, 4,649,048, 4,548,786 and 4,830,930. U.S. Pat. No. 4,911,989 describes a coated hard metal where the hardness increases monotonously in a 50–100 μm wide surface zone.

Different forms of gradient sintering for titanium-based carbonitride alloy have existed for a number of years. For example, grades exist with a few μm thick coating with strong binder phase enrichment and below that a binder phase depletion which extends 200–400 μm into the material with a gradual increase up the bulk level. This gradient type gives increased wear resistance which takes place with a certain loss of the toughness behavior. As expected, a hardness maximum is obtained just below the binder phase enriched zone where the enrichment of hard constituents is the greatest.

One way of improving the toughness behavior is through a relatively moderate binder phase enrichment to a depth of about 20–50 μm from the surface followed by an enrichment of hard constituents which then gives a hardness maximum. The binder phase enrichment gives a better toughness behavior but increases at the same time the risk for plastic deformation. The hard constituent enrichment increases the wear resistance (when the wear has reached this area) but increases the risk of crack propagation, i.e., deteriorates the toughness behavior at the same time as the resistance to plastic deformation increases.

An example of a variant of the above is U.S. Pat. No. 5,059,491, which discloses a hard surface layer with a hardness maximum situated between 5 and 50 μm from the surface and an outer surface zone with a hardness of between 20 and 90% of the maximum hardness. This is accomplished by starting the sintering process in an non-oxidizing atmosphere up to 1100° C. followed by a nitriding atmosphere which is finished by a denitriding atmosphere. The denitriding period comprises at least the cooling but can also comprise the whole or part of the sintering holding time.

Thus, normal gradient sintered hard alloys get a depletion of binder phase, i.e., an enrichment of hard constituents, just below the binder phase enrichment. This leads to increased wear resistance in this area with increased resistance to plastic deformation, but unfortunately also leads to a worsened toughness behavior.

OBJECTS AND SUMMARY OF THE INVENTION

It is an object of this invention to avoid or alleviate the problems of the prior art.

It is also an object of this invention to provide a sintered titanium carbonitride alloy with improved properties and a method of manufacturing said alloy.

In one aspect of the invention, there is provided a sintered titanium based carbonitride alloy body containing hard constituents based on, in addition to titanium, one or more of the metals Zr, Hf, V, Nb, Ta, Cr, Mo or W in 5–30% binder phase based on Co and/or Ni, said body having a binder phase enriched surface zone with higher binder phase content than in the inner portion of the body, said surface zone having an enrichment of simple hard constituents without a core-rim structure.

In another aspect of the invention, there is provided a method of manufacturing a sintered carbonitride alloy comprising:

wet milling of powders forming binder phase and powder forming hard constituents to a mixture with desired composition;

compacting said mixture to form compacts, said mixture being strongly substoichiometric regarding the interstitial balance;

and sintering after dewaxing said compacts by sintering a) in oxygen or air at 100°–300° C. for 10–30 minutes to completely transform the substoichiometric phases to stoichiometric, b) in vacuum to 1100°–1200° C., c) in vacuum at about 1200° C. for about 30 minutes, d) in deoxidizing $H_2$-atmosphere for 15–30 minutes at about 1200° C., e) in $N_2$-atmosphere during heating to sintering temperature 1400°–1600° C., and f) cooling to room temperature in vacuum or inert gas.

DETAILED DESCRIPTION OF THE PREFERRED EMBODIMENTS OF THE PRESENT INVENTION

According to the present invention, an enrichment of binder phase in the surface is accomplished but without an accompanying depletion of binder phase just below the enrichment in combination with a special structure in the surface zone. In this way, the above mentioned negative behavior is avoided. The resistance to plastic deformation is kept on an acceptably high level with the aid of an advanced core-rim-structure known through the U.S. Pat. No. 4,857,108.

The present invention comprises a sintered body of a carbonitride alloy with titanium as main component.

Figure 1:
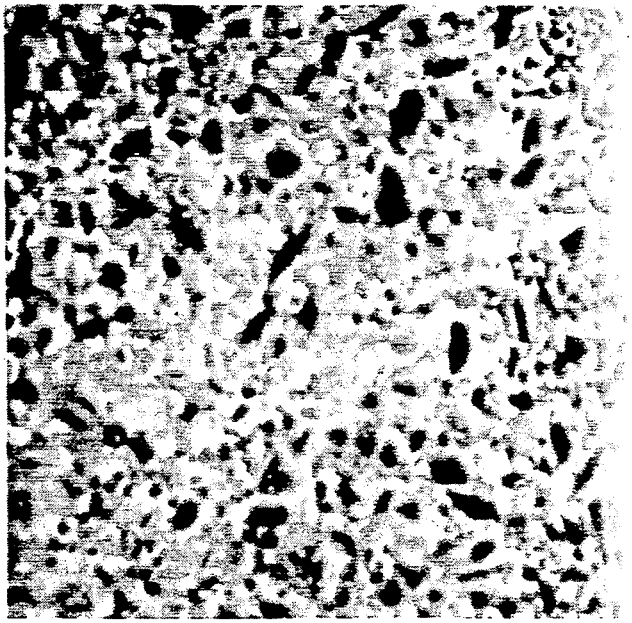
FIG. 1 shows the microstructure in about 5000 X magnification of the surface zone in an alloy according to the invention.
Figure 2:
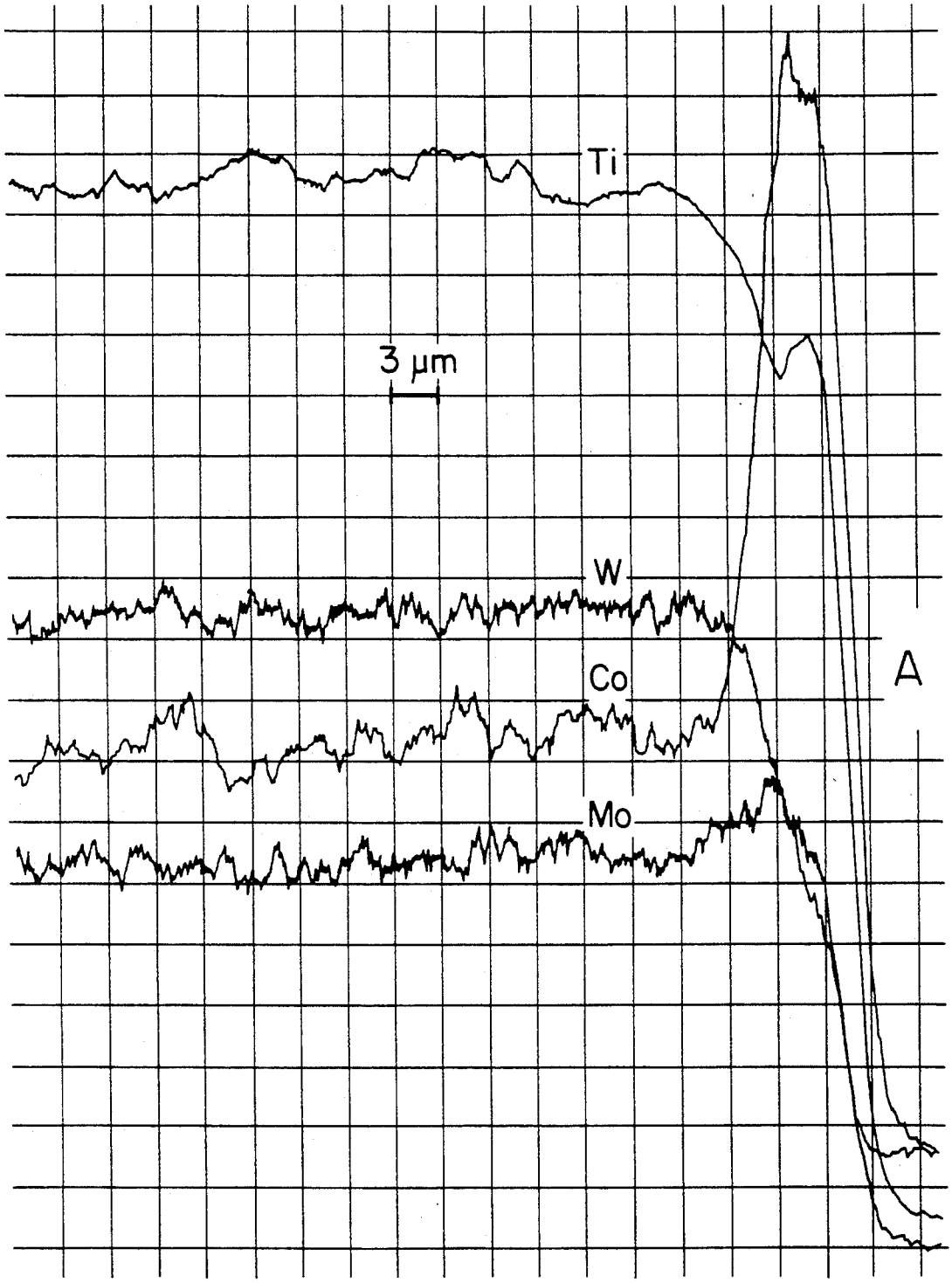
FIG. 2 shows a microprobe recording of the distribution of Co, W, Ti and Mo in the surface of an alloy according to the invention. In both figures the letter A indicates the outer surface.

Remaining hard constituent formers are Zr, Hf, V, Nb, Ta, Cr, Mo and/or W. Further, 5-30% by weight binder phase is included containing Co and/or Ni but also other hard constituent forming elements can be found in the binder phase. The alloy is further characterized in that it is built up of complex hard constituent grains with a core-rim structure of the type described in U.S. patent application Ser. No. 07/543,474, filed Jun. 26, 1990 and herein incorporated by reference. The alloy has been given toughness increasing properties through an enrichment of binder phase in a <25 μm, preferably 5-10 μm, wide surface zone without the above mentioned depletion of binder phase and corresponding enrichment of hard constituents in a zone just below the surface zone in combination with a certain microstructure. The binder phase content in the surface zone shall be at least 1.2, preferably 1.5-3, times greater than the binder phase content in the inner portion of the alloy. Certain hard constituent elements can also show a slight enrichment in the binder phase enrichment. In the surface zone, grains with core-rim-structure are essentially missing, i.e., in the surface zone, mainly 'simple' grains without the core-rim structure are present. The mean grain size in the surface zone is in addition finer, about 0.5 μm, whereas the inner portion of the material has a more normal mean grain size for the alloy of about 1-2 μm. This is illustrated by FIGS. 1 and 2.

In a preferred embodiment, the alloy comprises, in weight-%, <20% WC, 40-60% TiC+TiN, <10% of each of TaC, VC and $Mo_2C$ and 10-20% Co+Ni-binder phase. When the alloy contains molybdenum, the binder phase enrichment is accompanied by a slight enrichment of said element. In addition, the content of W, Mo, Ta and/or V increases slightly, <15% relatively, in a 150-200 μm wide surface zone whereas the titanium content decreases in the corresponding amount.

The above mentioned increase in wear resistance in a hard constituent enriched layer is not obtained with the present invention. Since such an effect, however, does not appear until after a considerable wear and the area of use for titanium based carbonitride alloys is finishing with a maintained sharp edge, such an increase in wear resistance is of less interest in order to obtain well functioning finishing tools. If a further increased wear resistance is of interest to a body according to the present invention, it is best obtained by coating with one or more layers according to known techniques, e.g., CVD or PVD. The alloy according to the present invention is very suitable as a substrate for coating with TiN or TiCN, e.g., by PVD-technique.

The good toughness behavior obtained with an outer binder phase enriched layer of a body according to the present invention has been further increased since the hard constituents in the outer zone have another structure than those in the inner portion of the body where, as above has been pointed out, there is a pronounced core-rim-structure. In the surface layer, the cores have not been dissolved and no rim formation has taken place which results in the hard constituent grains in the surface layer to a considerable extent having a homogeneous structure, i.e., not so much core-rim structure. The absence of the brittle rim phase gives further increased toughness.

The invention also relates to a powder metallurgical method for manufacturing a titanium based carbonitride alloy with improved properties. According to the method, powders forming binder phase and powders forming the hard constituents are mixed to form a mixture with desired composition. From the mixture, bodies are pressed and sintered. After dewaxing, the sintering is started with an oxidizing treatment in oxygen or air at 100°-300° C. for 10-30 min whereafter vacuum is pumped and maintained up to 1100°-1200° C. This is followed by a deoxidizing treatment in vacuum at 1200° C. for 30 min which afterwards is replaced by a deoxidizing $H_2$-atmosphere during a time at about 1200° C. The temperature is increased to the sintering temperature, 1400°-1600° C., in a nitrogen atmosphere. During the temperature increase and/or sintering time, a gradual decrease of the nitrogen content to zero may take place. Up to about 100 mbar Ar can with advantage be introduced during the sintering period. The cooling to room temperature takes place in vacuum or in inert gas.

An alternative to the oxidizing atmosphere in the initial stage of the sintering is to start with a strongly substoichiometric powder mixture regarding the interstitial balance and sinter the mixture under such conditions that possible substoichiometric phases are completely transformed to stoichiometric.

The invention is additionally illustrated in connection with the following Examples which are to be considered as illustrative of the present invention. It should be understood, however, that the invention is not limited to the specific details of the Examples.

EXAMPLE 1

A powder mixture of (in % by weight) 12.4% Co, 6.2% Ni, 34.9% TiN, 7.0% TaC, 4.4% VC, 8.7% $Mo_2C$ and 26.4 TiC was wet milled, dried and pressed to inserts of type TNMG 160408-QF which were sintered according to the following steps:

a) dewaxing in vacuum;
b) oxidation in air for 15 minutes at 150° C.;
c) heating in vacuum to 1200° C.;
d) deoxidation in vacuum at 1200° C. for 30 minutes;
e) flowing $H_2$ at 10 mbar for 15 minutes at 1200° C.;
f) flowing $N_2$ during heating to 1200°-1500° C.;
g) sintering in Ar at 10 mbar and 1550° C. for 90 minutes; and
h) cooling in vacuum X-ray diffraction analysis of the sintered alloy revealed only two types of lines, namely from a hard constituent phase in the form of cubic carbonitride and binder phase. Because the hard constituent phase is not homogeneous but has a varying composition, a considerable line broadening was obtained compared to analyzing simple, well defined phases. The following lattice constants were found:

| | Hard constituent, Å | Binder phase, Å |
|---|---|---|
| The surface zone of the insert | 4.274 | 3.588 |
| The inner zone of the insert | 4.288 | 3.594 |

The analysis shows that the insert surface contained more nitride and that the binder phase in the inner portion of the insert is more alloyed.

For comparison inserts were manufactured of the same type and the same composition according to U.S. Pat. No. 5,059,491.

EXAMPLE 2

The inserts from Example 1 were tested in an intermittent turning operation under the following conditions:

Work Piece: SS 2244

Cutting speed: 110 m/min

Cutting depth: 1.5 mm

Feed: 0.11 mm/rev which was increased continuously (doubled every 90th second)

Result: 50% of the inserts according to the invention fractured after 1.41 min corresponding to a feed of 0.21 mm/rev whereas 50% of the prior art inserts fractured after 0.65 min corresponding to a feed of 0.16 mm/rev.

Inserts according to the invention, thus, show a significantly better toughness.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Sintered titanium based carbonitride alloy body containing hard based on titanium as the main component and at least one metal taken from the group consisting of Zr, Hf, V, Nb, Ta, Cr, Mo and W in 5-30% binder phase based on a metal taken from the group consisting of Co, Ni and mixtures thereof, said body having a binder phase enriched surface zone with a higher binder phase content than in the inner portion of the body, said surface zone having an enrichment of simple hard constituents without a core-rim structure.

2. The sintered body of claim 1 wherein the binder phase content in the surface zone is at least 1.2 times higher than the binder phase content in the inner portion of the body.

3. The sintered body of claim 2 wherein the said binder phase content in the surface zone is 1.5-3 times higher than the binder phase content in the inner portion of the body.

4. The sintered body of claim 1 wherein the binder phase content just below the binder phase enriched surface zone is about the same level as the remainder of the body.

5. The sintered body of claim 1 wherein the grain size of the hard constituents in the surface is about 0.5 μm and in the rest of the body is about 1-2 μm.

6. The sintered body of claim 1 wherein said alloy comprises <20 WC, 40-60% TiC+TiN, <10% of each of TaC, VC and $Mo_2C$ and 10-20% Co+Ni-binder phase.

7. The sintered body of claim 1 wherein a 150-200 μm wide surface zone, the content of W, Mo, Ta and/or V increase <15% relatively whereas the titanium content decreases in the corresponding amount.

8. The sintered body of claim 1 wherein the said binder phase enriched surface zone is <25 μm width.

* * * * *